United States Patent [19]

Koyama

[11] 4,119,152

[45] Oct. 10, 1978

[54] LONG-DISTANCE SPRAYING DEVICE FOR FIRE HOSE

[76] Inventor: Yoshio Koyama, 8-10, 2-Chome, Shonaitakaramachi, Toyonaka City, Osaka Prefecture, Japan

[21] Appl. No.: 762,627

[22] Filed: Jan. 26, 1977

[51] Int. Cl.[2] ..... A62C 27/00

[52] U.S. Cl. ..... 169/25; 239/468; 239/553; 239/565; 239/587

[58] Field of Search ..... 239/468, 469, 553, 565, 239/587, 383; 169/25

[56] References Cited

U.S. PATENT DOCUMENTS

| | | | |
|---|---|---|---|
| 992,193 | 5/1911 | Hart | 169/25 X |
| 1,011,934 | 12/1911 | Fellows | 239/587 X |
| 2,342,757 | 2/1944 | Roser | 239/587 X |
| 3,804,336 | 4/1974 | Koeppe | 239/383 |

*Primary Examiner*—John J. Love
*Attorney, Agent, or Firm*—Holman & Stern

[57] ABSTRACT

A spraying device for a fire hose is provided with a bulb having a large inlet in one side and a plurality of small outlets in another side, the inlet being connected to the top end of a fire hose by way of a broad pipe, the outlets being connected to a plurality of annular nozzles by way of narrow pipes respectively in a manner that each narrow pipe is in the normal relation to the bulb wall, so as to convert the velocity head of water into pressure head through the bulb and deliver water through the nozzles a long distance in spray form.

1 Claim, 8 Drawing Figures

LONG-DISTANCE SPRAYING DEVICE FOR FIRE HOSE

The present invention relates to fire extinguishing equipment, and more particularly to a long-distance spraying device to be fitted at the discharge end of a fire hose.

When a room of a house or building is on fire, it means that inflammable materials are heated over their ignition points with air in the room. It is therefore necessary either to cool the inflammables to under their ignition points or to extract air from the room in order to extinguish the fire. In usual cases, the former way of fire extinguishing is adopted, and water is delivered to the fire for the cooling purpose because it has a high thermal capacity and good availability. Fire hoses are most commonly employed for the delivery of water.

Conventionally a fire hose is provided with a nozzle or nozzles. The nozzle is connected to the discharge end of the hose by the intermediary of a play pipe. The nozzle and play pipe provide a much narrower water conduit than the hose itself. The nozzle is generally of the type to discharge water either in a straight stream or in a spray.

The conventional straight-stream nozzle is typically provided with a plainly bored water conduit. It delivers water in a relatively narrow straight stream to a room of relatively great space burning in a fire, thus often failing to cool a great amount of inflammables under their ignition points quickly enough for the emergency in the room. Besides, such a narrow water stream cannot absorb smoke sufficiently to save a person from suffocation in a room filled with smoke but not yet alight.

The conventional spray nozzle is typically provided with a porous water conduit. It delivers water in a wide spray to a room burning or smoking in a fire, thus making it possible to overcome the above-mentioned disadvantages of a straight-stream nozzle at least theoretically. However a spray nozzle with a porous conduit cannot deliver water to a distance longer than 3 to 5 m from the nozzle. Since it is mostly impossible to bring the nozzle of a fire hose so near to a hazardous room in a fire, the spray nozzle often fails to extinguish a fire or save a person from suffocation.

Even the conventional straight-stream nozzle generally cannot deliver water to a distance longer than 30 m from the nozzle, and thus water often falls short of the distance sufficient for fire extinguishing purposes.

It is worth considering why the conventional nozzles cannot deliver water to a relatively long distance. When water is forcibly supplied through a fire hose with a given water head, the velocity of water increases substantially as it passes the play pipe and nozzle following the hose, because the play pipe and nozzle provide a much narrower conduit than the hose itself. This means that the pressure head of water will be converted for the most part into velocity head and thus increase the velocity head of water substantially through the conduit of the play pipe and nozzle, given the water head when water passes the discharge end of hose; here the water head may be practically regarded as the sum of pressure head and velocity head. However the velocity head of water will be lost for a large part due to the hydrodynamic resistance through the relatively narrow conduit of the play pipe and nozzle, and the remaining velocity head will drive water from the nozzle. There will remain almost no part of the pressure head to be converted into velocity head at the moment when water leaves the nozzle.

In other words, the water head will mostly take the form of velocity head, and a large part of it will be lost due to the hydrodynamic resistance, as water passes the narrow conduit of the play pipe and nozzle; and the remaining water head will drive water from the nozzle. This may be the main reason why the conventional nozzles cannot deliver water to a relatively long distance.

Moreover in the case of the conventional spray nozzle with a porous conduit, water spreads to a wide spray immediately after it leaves the nozzle. This will increase the hydrodynamic resistance against water through the atmosphere abruptly to a great extent, and thus the above-mentioned remaining velocity head of water which drives water from the nozzle will be completely lost immediately after it leaves the nozzle. This may be the main reason why the conventional spray nozzle falls much shorter of the water delivery distance than the straight-stream nozzle.

It follows that water can be delivered to a relatively long distance from the nozzle, if on a small part of the water head is lost due to the hydrodynamic resistance as water passes the relatively narrow conduit of the play pipe and nozzle, for a particular water head at the discharge end of hose. If the water head mostly takes the form of pressure head, a small part of it will be lost due to the hydrodynamic resistance through the narrow conduit of the play pipe and nozzle, because pressure head of water is not lost due to hydrodynamic resistance.

It also follows that the delivery distance for a water spray can be increased substantially, if water spreads to be wide spray not immediately but substantially after it leaves the nozzle. If the nozzle discharges water in a relatively narrow annular stream, it will mix with air well and thus spread to a wide spray not immediately but substantially after it leaves the nozzle.

A main object of the invention is to provide a spraying device for fire hose to deliver water in a spray to a substantially long distance.

A more specific object of the invention is to provide a spraying device for a fire hose by which the velocity head of water forcibly supplied through the hose is mostly converted into pressure head through a bulb and then such water is discharged through a plurality of play pipes and annular nozzles.

Other objects and advantages of the invention will be readily appreciated and become better understood hereinafter when considered in connection with the accompanying drawings in which.

Figure 1:
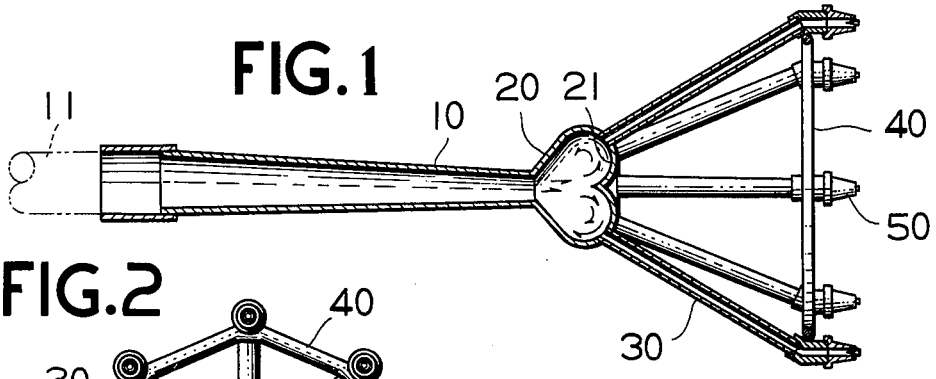
FIG. 1 is a vertical section of a portable-type spraying device embodying the invention, attached at the discharge end of a fire hose.
Figure 2:
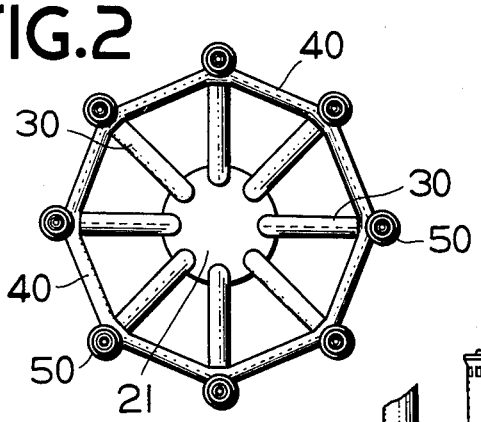
FIG. 2 is an end view of FIG. 1.
Figure 3:
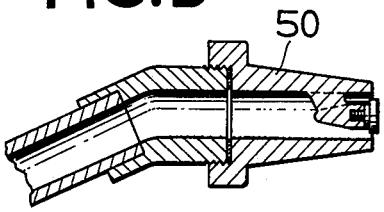
FIG. 3 is a vertically-sectioned fragmentary view of one of the nozzle portions in FIG. 1.

The embodiment shown in FIGS. 1, 2 & 3 primarily comprises a bulb 20, a connecting pipe 10 provided at one side of the bulb 20, a plurality of play pipes 30 provided at the opposite side of bulb 20, and a plurality of nozzles 50 attached to the play pipes 30 respectively.

The bulb 20 is substantially heart-shaped as shown in FIG. 1. It is provided with an inlet in the tail of the heart shape, and a plurality of outlets radially arranged in the shoulder of the heart shape, the shoulder being indicated as 21. Each of the outlets is much smaller than the inlet.

One end of the connecting pipe 10 is connected to the inlet of bulb 20, and the other end of the same pipe is connected to the discharge end of a hose 11.

The ends of the play pipes 30 are connected to the outlets of bulb 20, and the other ends of the same pipes are connected to the nozzles 50, respectively. The play pipes 30 each have the same configuration and dimensions. Each play pipe 30 is in the normal relation to the shoulder 21 at the corresponding outlet of bulb 20.

The nozzles 50 have the same configuration and dimensions. They are held firm in their positions by a brace 40 as best shown in FIG. 2. Each nozzle 50 is provided with an annular water conduit as best shown in FIG. 3.

The connecting pipe 10 and bulb 20 provide a water conduit which is not substantially narrower than the hose 11. The conduit of connecting pipe 10 and bulb 20 is much shorter than the hose 11. Each play pipe 30 and the corresponding nozzle 50 provide a water conduit which is much narrower than the hose 11.

In operation, water is supplied forcibly through the hose 11 continuously. After it passes the discharge end of hose 11, water enters the bulb 20 by way of the connecting pipe 10. The velocity head of water will be lost to a practically negligible degree due to the hydrodynamic resistance as it passes the conduit of connecting pipe 10 and bulb 20, because the same conduit is not substantially narrower than the hose 11, and because it is much shorter than the hose 11; the pressure head of water will remain almost unchanged practically through the same conduit, and the water head when water passes the discharge end of hose 11 may be practically regarded as the sum of pressure head and velocity head. Therefore the loss of water head will be practically negligible through the conduit of connecting pipe 10 and bulb 20.

Within the bulb 20 water rotates as indicated by arrows in FIG. 1. As water flows along the shoulder 21 of bulb 20, some part of it leaves the bulb 20 and enters the play pipes 30 in the normal relation to the flow rotating in the bulb 20, because each play pipe 30 is in the normal relation to the shoulder 21 at the corresponding outlet of bulb 20. The normal departure of water will cause the water energy to be transferred mostly in the state of pressure energy from the flow in bulb 20 to the flows in play pipes 30. In other words, the water head will mostly take the state of pressure head when water leaves the bulb 20 and enters the play pipes 30. This means that the velocity head of water will be converted for the most part into pressure head, and the pressure head of water will remain almost unchanged, when water leaves the bulb 20 and enters the play pipes 30.

Then water passes the play pipes 30 and nozzles 50 slowly, and all this while the water head will mostly take the state of pressure head. No part of the pressure head will be lost due to the hydrodynamic resistance through each of the relatively narrow conduits of play pipes 30 and nozzles 50, because pressure head of water is not lost at all due to hydrodynamic resistance. Therefore almost no part of the water head will be lost through the narrow conduits of play pipes 30 and nozzles 50.

At the moment when water leaves the nozzles 50, the pressure head of water will be all converted into velocity head, and this will drive water outward from the nozzles 50.

Since almost no part of the water head will be lost through the narrow conduits of play pipes 30 and nozzles 50 but almost all of it is utilized to drive water outward from the nozzles 50, water can be delivered to a relatively long distance from the nozzles 50, for the particular water head when water passes the discharge end of hose 11.

Because each nozzle 50 is provided with a relatively narrow annular conduit, water is discharged from the nozzle 50 in a relatively narrow annular stream. When the narrow annular stream is delivered to a relatively long distance through atmosphere from the nozzle 50, it mixes with air well and thus spreads to a wide spray. In fact, the embodiment can deliver water is spray to a distance as long as 50 to 80 m from the nozzles 50, in case water is forcibly supplied through the hose 11 with such a water head as given by a conventional fire pump. It can therefore be said that the spraying device embodying the invention delivers water in spray to a substantially long distance.

Since a plurality of annular streams are delivered from the nozzles 50, they result in a wide spray in total at a substantially long distance from the nozzles 50. Such a wide spray can absorb smoke sufficiently to save a person from suffocation as well as cool a great amount of inflammables to under their ignition points in a great space quickly enough for the emergency in a fire. In other words, such a wide spray can serve not only to extinguish fire but also save life quite efficiently and effectively in fire disasters.

The delivery for water spray can be varied desiredly to some extent by adjusting the annularity of nozzles 50.

Figure 4:
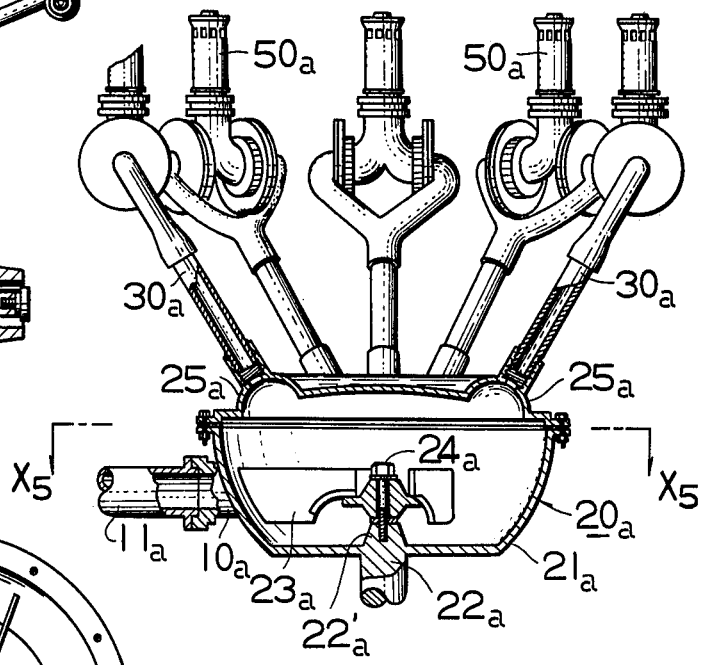
FIG. 4 is a partially-sectioned vertical elevation of a monitor-type spraying device, in part, embodying the invention and equipped at the discharge end of a fire hose.
Figure 5:
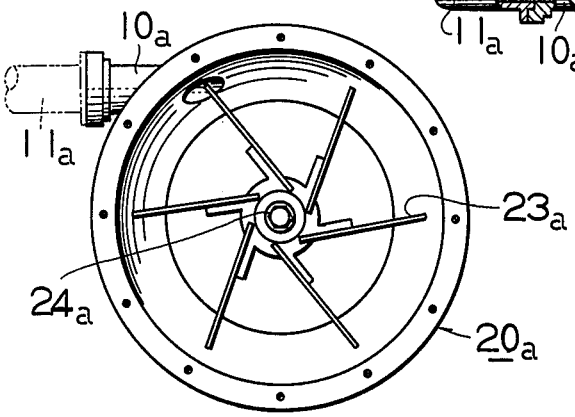
FIG. 5 is a cross section on line X5-X5 in FIG. 4.
Figure 6:
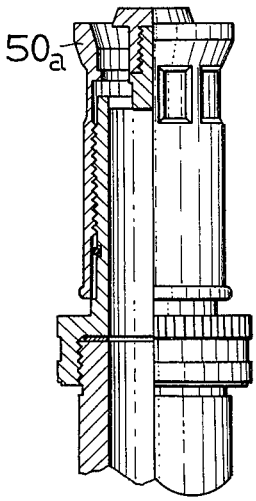
FIG. 6 is a partially-sectioned fragmentary view of one of the nozzle portions in FIG. 4.

The embodiment shown in FIGS. 4, 5 & 6 primarily comprises a bulb 20*a*, a connecting pipe 10*a* provided at one side of the bulb 20*a*, a plurality of play pipes 30*a* provided on another side of the bulb 20*a*, and a plurality of nozzles 50*a* attached to the play pipes 30 respectively.

The bulb 20*a* consists of a round vessel 21*a*, a round cover provided on the top of vessel 21*a*, and a supporting member 22*a* provided through the bottom of vessel 21*a*, as best shown in FIG. 4.

The bulb vessel 21*a* is provided with an inlet in its round side wall. The bulb cover is fixed to the vessel 21*a* in a watertight manner. The bulb cover is provided with an annular shoulder 25*a* in its periphery. The annular shoulder 25*a* is provided with a plurality of outlets in a radial arrangement. Each of the outlets in the shoulder 25*a* of bulb cover is much smaller than the inlet in the side wall of bulb vessel 21*a*.

The bulb supporting member 22*a* is a vertical rod. The upper end of supporting member 22*a* which is indicated as 22'*a* projects into the vessel 21*a*, the lower end of the same member is fixed to a base (not shown), and a middle portion intermediate both ends of the same member is fixed to the center of the bottom of vessel 21*a* in an integral relation. The upper end 22'*a* of supporting member 22*a* is provided with an impeller 23*a*, which is provided with a plurality of blades and connected to the upper end 22'a with a pin 24a in a relatively rotatable relation therewith.

One end of the connecting pipe 10a is connected to the inlet in the round side wall of bulb vessel 21a in a substantially tangential relation, and the other end of the same pipe is connected to the discharge end of a hose 11a.

The play pipes 30a are each connected at one of their ends to the outlets in the shoulder 25a of bulb cover, and the other ends of the same pipes are connected to the nozzles 50a, respectively. The play pipes 30a have the same configuration and dimensions. Each play pipes 30a is in the normal relation to the shoulder 25a at the corresponding outlet in the bulb cover.

The nozzles 50a have the same configuration and dimensions. Each nozzle 50a is provided with an annular water conduit as shown in FIG. 6. Each nozzle 50a is provided with a pair of rotary joints to vary the angle of nozzle 50a in relation to the corresponding play pipe 30a, as shown in FIG. 4.

The connecting pipe 10a and bulb 20a provide a water conduit which is not substantially narrower than the hose 11a. The conduit of connecting pipe 10a and bulb 20a is much shorter than the hose 11a. Each play pipe 30a and the corresponding nozzle 50a provide a water conduit which is much narrower than the hose 11a.

In operation, water is supplied forcibly through the hose 11a. After it passes the discharge end of hose 11a, water enters the bulb 20a by way of the connecting pipe 10a. The velocity head of water will be lost to a practically negligible degree due to the hydrodynamic resistance as it passes the conduit of connecting pipe 10a and bulb 20a, because the same conduit is not substantially narrower than the hose 11a, and because it is much shorter than the hose 11a; the pressure head of water will remain almost unchanged practically through the same conduit, given the water head when water passes the discharge end of hose 11; here the water head may be practically regarded as the sum of pressure head and velocity head. Therefore the loss of water head will be practically negligible through the conduit of connecting pipe 10a and bulb 20a.

Within the bulb 20a circulated water drives the impeller 23a as best indicated in FIG. 5. As water flows along the shoulder 25a of bulb cover, some part of it leaves the bulb 20a and enters the play pipes 30a in normal relation to the flow rotating in the bulb 20a, because each play pipe 30a is in normal relation to the shoulder 25a at the corresponding outlet of bulb cover. The normal departure of water will cause the water energy to be transferred mostly in the state of pressure energy from the flow in bulb 20a to the flows in play pipes 30a. In other words, the water head will mostly take the form of pressure head when water leaves the bulb 20a and enters the play pipes 30a. This means that the velocity head of water will be converted for the most part into pressure head, and the pressure head of water will remain almost unchanged, when water leaves the bulb 20a and enters the play pipes 30a.

Then water passes the play pipes 30a and nozzles 50a slowly, and all this while the water head will mostly take the state of pressure head. No part of the pressure head will be lost due to the hydrodynamic resistance through each of the relatively narrow conduits of play pipes 30a and nozzles 50a, because pressure head of water is not lost at all due to hydrodynamic resistance. Therefore almost no part of the water head will be lost through the narrow conduits of play pipes 30a and nozzles 50a.

At the moment when water leaves the nozzles 50a, the pressure head of water will be all converted into velocity head, and this will drive water outward from the nozzles 50a.

Since almost no part of the water head will be lost through the narrow conduits of play pipes 30a and nozzles 50a but almost all of it is utilized to drive water outward from the nozzles 50a, water can be delivered to a relatively long distance from the nozzles 50a, for the particular water head at which the water passes the discharge end of hose 11a.

Because each nozzle 50a is provided with a relatively narrow annular conduit, water is discharged from the nozzle 50a in a relatively narrow annular stream. When the narrow annular stream is delivered to a relatively long distance through atmosphere from the nozzle 50a, it mixes with air well and thus spreads to be wide spray. In fact, the embodiment can deliver water in spray to a distance as long as 50 to 80 m from the nozzle 50a, in the case where water is forcibly supplied through the hose 11a with such a water head as given by a conventional fire pump. It can therefore be said that the spraying device embodying the invention delivers water in spray to a substantially long distance.

Since a plurality of annular streams are delivered from the nozzles 50a, they result in a wide spray in total at a substantially long distance from the nozzles 50a. Such wide spray can absorb smoke sufficiently to save a person from suffocation as well as cool a great amount of inflammables under their ignition points in a great space quickly enough for the emergency in a fire. In other words, such a spray can serve not only to extinguish fire but also save life from suffocation quite efficiently and effectively in fire disasters.

The delivery distance for water spray can be varied desiredly to some extent by adjusting the annularity of nozzles 50a. The delivery angle for water spray can also be varied desiredly to some extent by utilizing the rotary joints of nozzles 50a.

Figure 8:
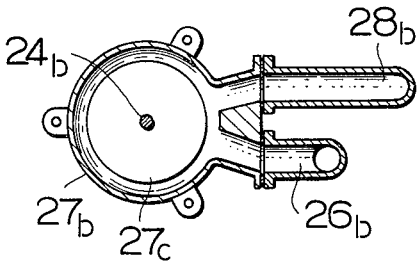
FIG. 8 is a cross section on line X8-X8 in FIG. 7.
Figure 7:
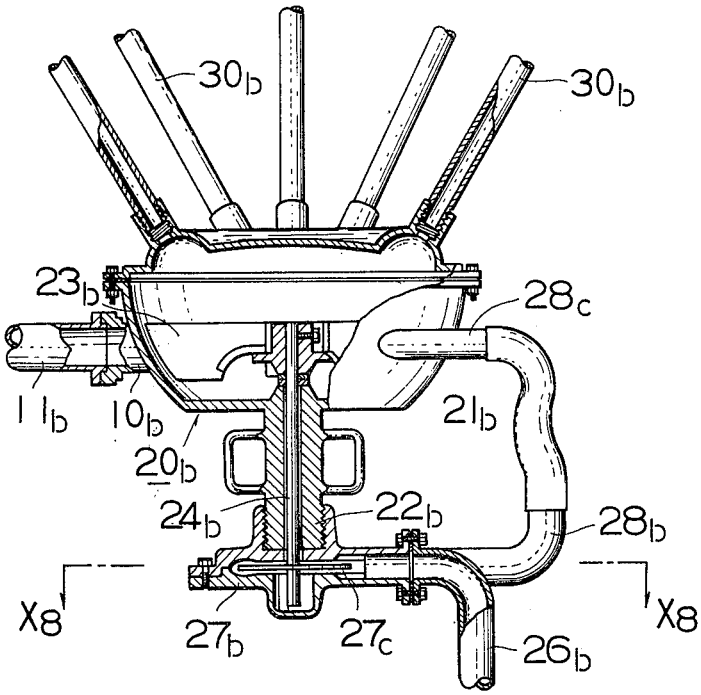
FIG. 7 is a partially-sectioned vertical elevation of a monitor-type spraying device with a proportioning device, attached at the discharge end of a fire hose.

The embodiment shown in FIGS. 7 & 8 has a construction similar to the preceding embodiment shown in FIGS. 4 to 6 except that it is provided with a proportioning device to add foaming agent to water in a given ratio before water is delivered from the nozzles.

The embodiment shown in FIGS. 7 & 8 primarily comprises a bulb 20b, a connecting pipe 10b provided at one side of the bulb 20b, a plurality of play pipes 30b provided at another side of bulb 20b, a plurality of nozzles (not shown) attached to the play pipes 30b respectively, and a proportioning device attached to the bulb 20b.

The bulb 20b consists of a round vessel 21b, a round cover provided on the top of vessel 21b, and a supporting member 22b provided through the bottom of vessel 21b.

The bulb supporting member 22a is a hollow vertical shaft. The upper end of supporting member 22b projects into the vessel 21b, and a middle portion a little below the upper end of the same member is fixed to the center of bottom of vessel 21b in an integral relation.

The proportioning device consists of a pump casing 27b, a pump impellter 27c, another impeller 23b, a common shaft 24b, a suction pipe and a delivery pipe.

The pump casing 27b is fixed to the lower end of bulb supporting member 22b. The common shaft 24b is substantially longer than the supporting member 22b. The common shaft 24b is inserted into the supporting member 22b in a manner that the upper end of the shaft projects into the bulb vessel 21b and the lower end of the shaft projects into the pump casing 27b. The pump impeller 27c is fixed to the lower end of common shaft 24b in the pump casing 27b. The other impeller 23b is fixed to the upper end of common shaft 24b in the bulb vessel 21b, and connected to the upper end of bulb supporting member 22b in a relatively rotatable relation.

The pump casing 27b is provided with a suction port and a delivery port. One end 26b of the suction pipe is connected to the suction port of pump casing 27b, and the other end of the same pipe is connected to a source (not shown) of foaming agent. One end 28b of the delivery pipe is connected to the delivery port of pump casing 27b, and the other end 28c of the same pipe is connected to the round side wall of bulb vessel 21b in a substantially tangential relation.

In other aspects the embodiment shown in FIGS. 6 & 7 has the same construction as the preceding embodiment shown in FIGS. 4 to 6.

Water enters and leaves the device shown in FIGS. 6 & 7 similarly to the embodiment shown in FIGS. 4 to 6 and water can also be delivered in spray to a substantially long distance from the device.

As water is circulated in the bulb 20b, it drives the impeller 23b and this in turn drives the pump impeller 27c by the intermediary of common shaft 24b at a given speed, dependent on the water head at the discharge end of hose 11b. Then the pump impeller 27c forcibly supplies foaming agent from the source (not shown) to the bulb 20b by way of the pump casing 27b through the suction pipe and delivery pipe, and thus foaming agent is added to water in a given ratio in the bulb 20b. Water and foaming agent are mixed as they forcibly flow through the bulb 20b, play pipes 30b and nozzles.

Water spray which contains foaming agent as mentioned above will be quite effective to a fire in which a large amount of high molecular matter such as synthetic resin burns and thus produces a great amount of toxic gas, because such foaming spray can serve not only to extinguish the fire but also absorb the gas quite satisfactorily for the emergency. Such foaming spray will also be quite effective where a large amount of oil is burning and/or leaking, because such foaming spray can serve not only to extinguish the fire but also seal the leaking oil against fire quite satisfactorily for the emergency.

It will be understood that further modifications may be made in the construction of the above-given embodiments, and that the invention is in no way limited to the above-given embodiments.

What is claimed is:

1. A spraying device for the discharge end of a fire hose, comprising a bulb member, a connecting pipe provided at one side of said bulb member, a plurality of play pipes provided at another side of said bulb member, and a plurality of nozzles attached to said play pipes respectively; said bulb member comprising a round vessel, a round cover provided on the top of said vessel, and a vertical supporting member provided through the bottom of said vessel, said round vessel having a side wall provided with a water inlet, said round cover being provided with an annular shoulder in its periphery, said annular shoulder being provided with a plurality of water outlets in a radial arrangement, said water outlets being substantially smaller than said water inlet, the upper end of said vertical supporting member projecting into said vessel, the lower end of said vertical supporting member being fixed to base means, a middle portion of said supporting member being fixed to the bottom of said vessel, said upper end of said supporting member being provided with impeller means in a relatively rotatable relation thereto; one end of said connecting pipe being connected to said water inlet in a substantially tangential relation to said side wall, said play pipes each being connected at one end to respective ones of said water outlets, the other ends of said play pipes being connected to said nozzles, said nozzles each being provided with an annular water conduit, said nozzles being provided with means to vary the angle thereof in relation to the corresponding play pipe, said play pipes and the corresponding nozzles each providing a water conduit substantially narrower than the other end of the connecting pipe.

* * * * *